United States Patent [19]

Dick

[11] Patent Number: 4,971,527

[45] Date of Patent: Nov. 20, 1990

[54] REGULATOR VALVE FOR AN INK MARKING SYSTEM

[75] Inventor: George H. Dick, Chicago, Ill.

[73] Assignee: Videojet Systems International, Inc., Elk Grove Village, Ill.

[21] Appl. No.: 176,228

[22] Filed: Mar. 30, 1988

[51] Int. Cl.[5] ..... F04B 21/00

[52] U.S. Cl. ..... 417/310; 137/115; 417/311; 417/540

[58] Field of Search ..... 417/307, 310, 311, 540, 417/302, 303; 137/115, 510

[56] References Cited

U.S. PATENT DOCUMENTS

| | | | |
|---|---|---|---|
| 2,654,323 | 10/1953 | Wahlmark | 417/303 |
| 3,694,105 | 9/1972 | Martin | 417/26 |
| 3,774,628 | 11/1973 | Norton et al. | 137/115 |
| 4,472,112 | 9/1984 | Unger | 417/311 |
| 4,555,719 | 11/1985 | Arway et al. | 137/510 X |
| 4,602,662 | 7/1986 | Eremity et al. | 141/198 |

FOREIGN PATENT DOCUMENTS

| | | | |
|---|---|---|---|
| 454067 | 1/1949 | Canada | 137/510 |
| 548722 | 11/1957 | Canada | 137/115 |
| 929603 | 6/1955 | Fed. Rep. of Germany | 137/510 |
| 2016658 | 9/1979 | United Kingdom | 137/115 |

*Primary Examiner*—Leonard E. Smith

*Attorney, Agent, or Firm*—Jones, Day, Reavis & Pogue

[57] ABSTRACT

A unitary pump, regulator valve/pulsation dampener, and interconnecting passageways is provided. The regulator valve/pulsation dampener includes a flexible member disposed in a chamber arranged between the fluid input and fluid output. The diaphragm flexes as a function of the pressure in the chamber to control the opening and closing of a bypass valve member and, in addition, damps out both high and low frequency pulsations generated in the ink by the pump. When the pressure in the system increases beyond a predetermined limit the valve member is opened to divert some of the fluid flow into a bypass passageway until the pressure falls below the predetermined limit. The pressure limit in the system can be varied by adjusting the external pressure applied to the flexible member using an adjustment screw and compression spring.

10 Claims, 2 Drawing Sheets

REGULATOR VALVE FOR AN INK MARKING SYSTEM

BACKGROUND OF THE INVENTION

The invention relates, generally, to an ink marking system and, more particularly, to an improved regulator valve/pulsation dampener for controlling the flow of ink to the jet nozzle of the ink marking system.

Oftentimes continuous flow ink jets use gear pumps to provide the ink pressure in the system and a fixed needle valve or a pressure relief valve to bypass some of the pump capacity back to the reservoir or pump inlet. The ink which is to be used for printing is taken from the high pressure portion of the fluid circuit and dropped through a small conventional "down stream" regulator. The ink is then sent through a separate component where the gear tooth frequency pulsations from the pump are dampened out.

One major drawback of the above-described prior art devices is that the pump is required to work against a pressure of at least 10 psi greater than the pressure needed by the ink at the jet nozzle. Because the pump must work at this higher level, energy is wasted and unnecessary wear is generated on the pump, prematurely shortening its life.

One way to avoid operating the pump in this manner is to provide a back pressure regulator which allows the pump to work only against the pressure needed by the nozzle. However, the use of such a conventional back pressure regulator still requires a separate component to smooth out the high frequency pulsations in the ink caused by the gear pump.

In addition to minimizing the pressure against which the pump must work, it is desirable to minimize the number of components in the fluid circuit and provide as compact a unit as possible. The more compact and unitary the design the lower the parts costs, assembly time, and the fewer the number of fittings and potential leak points.

SUMMARY OF THE INVENTION

The present invention is a unitary pump, regulator valve/pulsation dampener, and interconnecting passageways. This unitary construction results in a more compact system which is easier and cheaper to assemble than the known prior art systems. Moreover, potential leak points are minimized because there are no pipes, tubes or fittings except for the suction line from the reservoir and the pressure line to the ink jet printhead.

The unitary module includes a pair of meshing gears which pressurize the ink from the reservoir. The pressurized ink normally flows passed the regulator valve to the jet nozzle. However, when the pressure of the ink exceeds a predetermined limit, the regulator valve opens to divert some of the ink flow from the jet nozzle to a bypass passage until the pressure falls below the predetermined limit.

The regulator valve includes a valve member biased into engagement with a valve seat at the mouth of the bypass passage by a first spring to prevent the flow of ink there through. A flexible diaphragm is disposed between the valve member and the first spring such that the ink flows passed the flexible diaphragm to the discharge line. When the ink pressure exceeds the predetermined limit the diaphragm is flexed thereby to compress the first spring and allow the valve member to separate from the valve seat. A second spring provides the force to move the valve member from the valve seat and allow the ink to flow into the bypass passage. Once the pressure has been reduced below the predetermined limit the first spring moves the valve member back into engagement with the valve seat and the diaphragm to its original unflexed position.

The flexible diaphragm is disc shaped and has a relatively large diameter and thin cross-section. The center portion of the diaphragm is supported by the first spring while an intermediate, generally annular portion is unsupported. As a result, low frequency pulsations in the ink are absorbed by the movement of the entire diaphragm and the compression of the first spring while high frequency pulsations are absorbed by the unsupported material comprising the intermediate portion of the diaphragm. Thus, the diaphragm performs the dual functions of controlling the regulator valve and dampening the pulsations in the ink generated by the gear pump.

OBJECTS OF THE INVENTION

It is a general object of the invention to provide an improved regulator valve and dampener for the ink supply system of an ink jet printer.

It is another object of the invention to provide a compact unitary module containing the pump, regulator valve/pulsation dampener and filter of the system to minimize assembly time, costs and minimize the number of potential leak points.

It is a further object of the invention to provide a single mechanism that functions as both the activating device for the regulator valve and the dampener of the pulsations in the ink.

It is still a further object of the invention to provide an ink marking system in which the pump works only against the ink pressure needed by the nozzle.

Other objects of the invention, in addition to those set forth above, will become apparent to one of ordinary skill in the art from the following detailed description.

BACKGROUND OF THE INVENTION

Figure 1:
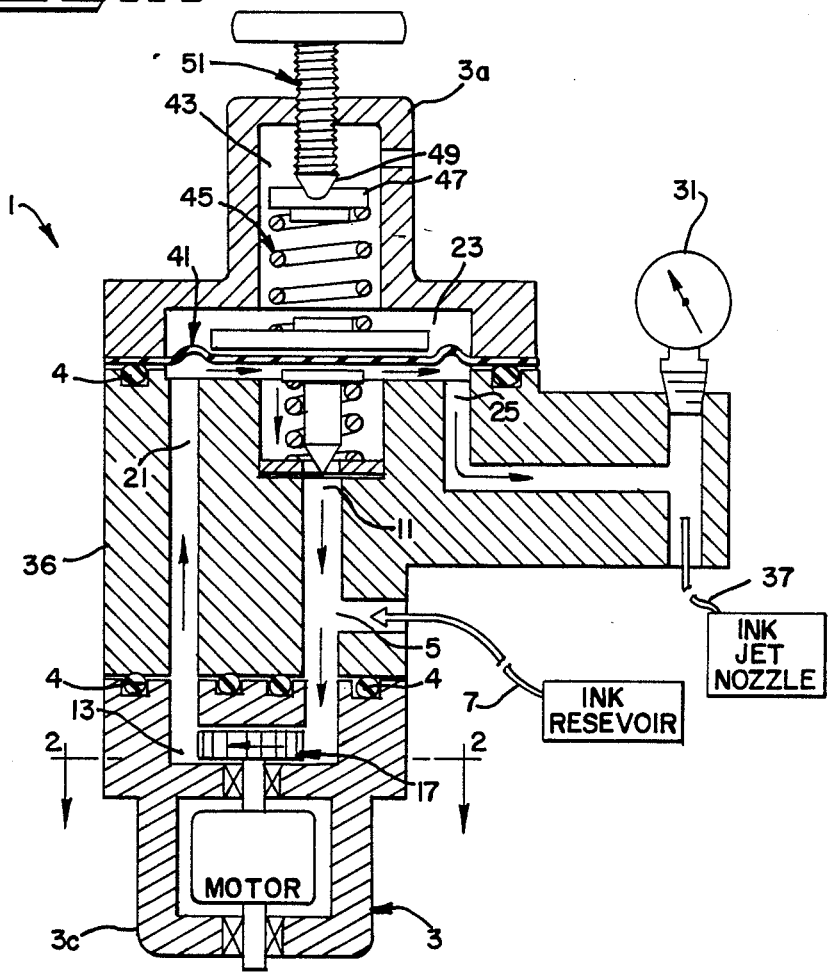
FIG. 1 is a sectional view of the invention including the regulator valve/pulsation dampener of the invention.
Figure 2:
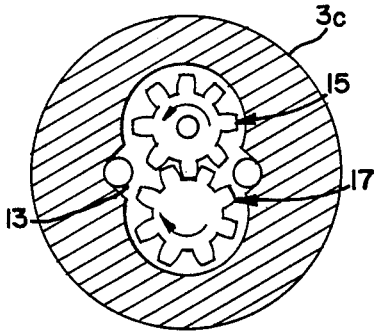
FIG. 2 is a sectional view taken along line 2—2 of FIG. 1.

FIG. 1 shows a section view of the invention 1 which includes a unitary body 3 consisting of an upper body portion 3*a*, central body portion 3*b*, and lower body portion 3*c* made, preferably, of a rigid plastic material. The body portions are secured together by any suitable means such as by screws or a clamping ring (not shown) and have O-rings 4 located therebetween to provide a liquid-tight seal.

An input passageway 5 is formed in the wall of central body portion 3*b* and connects to the suction line 7 of an ink reservoir. The input passageway 5 connects with the bypass passageway 11 which, in turn, connects with pump chamber 13. Pump chamber 13 contains gears 15 and 17 which are rotateably driven in meshing engagement by a motor to provide suction in the system and pressurize the ink in the bypass and input passageways.

The pump chamber 13 is connected to the regulator chamber 23 via exit passageway 21. The regulator chamber 23 is connected to bypass passageway 5 and to the regulator exit passageway 25 such that the ink can be selectively discharged from the regulator chamber 23 to the jet nozzle 36 or to the pump chamber 13. A pressure gauge 31 is provided in the regulator exit passageway 25 to indicate the ink pressure entering the jet nozzle at the printer head via pressure line 37. A flexible diaphragm 41 is formed as a disk of resilient material and is supported at its edge in the regulator chamber 23 between the upper body portion *3a* and the central body portion *3b* to form a liquid-tight seal therewith such that the ink is constrained to flow between the flexible diaphragm 41 and the central body portion *3b*.

Figure 4:
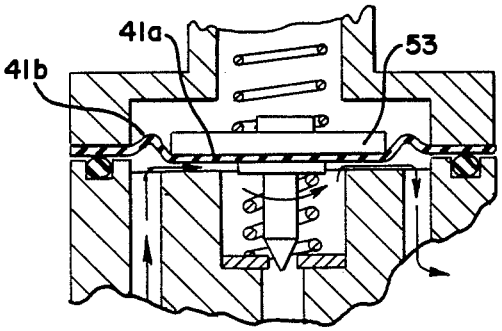

Formed in the upper body portion *3a* is a cylindrically shaped cavity 43. Centrally located in cavity 43 is a first compression spring 45 disposed such that its spring force is directed perpendicular to the diaphragm 41. The spring 45 has a seat 47 secured to one end thereof provided with a recess 49 for receiving the tip of adjustment screw 51. Secured to the other end of spring 45 is a circular pressure plate 53 which remains in continuous contact with flexible diaphragm 41 to evenly transfer the force of the spring 45 to the central portion 41*a* of the diaphragm 41 that is coextensive with the plate 53 as shown in FIG. 4. The immediate annular portion 41*b* of the diaphragm 41 which is disposed between the body 3 and pressure plate 53 is unsupported in the direction perpendicular to the surface of diaphragm 41, the function of which will be hereinafter explained. By tightening or loosening screw 51 the force from spring 53 on the diaphragm 41 can be increased or decreased, respectively.

Figure 3:
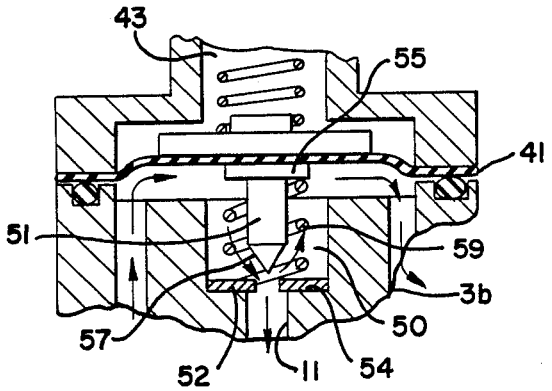
FIGS. 3 and 4 show detailed sectional views of the regulator valve/pulsation dampener in an opened position and a closed position, respectively.

Referring to FIG. 3, a second cylindrically shaped cavity 50 is located in the central body portion *3b* and is arranged in line with the diaphragm 41 and first cavity 43. The mouth of bypass passageway 11 is located in the center of the bottom of cavity 50 to form an annular ledge 52 on which is located an annular valve seat 54. A valve member 51 is centrally located in cavity 50 and is formed with a valve stem end 57 and a flanged head 55. A second compression spring 59 is coaxially arranged over the valve member 51 and is constrained between the annular valve seat 54 and the flanged head 55. The spring force acts along the axis of the valve member to force the flanged head 55 into continuous engagement with the diaphragm 41. Thus, the diaphragm 41, valve member 51 and pressure plate 53 will reciprocate as a unit under the forces generated by the first compression spring 45, the second compression spring 59 and the pressurized ink, as will be hereinafter described.

OPERATION

In operation the motor 19 is energized to rotate the gears 15 and 17. The rotating gears develop a suction at the input of the pump chamber 13 to pressurize the ink such that it flows from the reservoir 9, through suction line 7, input passageway 5 and bypass passageway 11. The ink under pressure is discharged from the pump chamber 13 into the pump exit passageway 21. The ink flows from the pump exit passageway 21 to the regulator chamber 23 where it flows passed the flexible diaphragm 41 between the diaphragm and the central body portion *3b*, as illustrated by arrows in FIG. 1, 3 ad 4.

The ink, because it is under pressure, exerts an upward force on the flexible diaphragm 41 as it flows through the regulator chamber 23. When the force exerted on the diaphragm 41 due to the combined forces of the pressurized ink and the second spring 59 is less than the opposing force exerted on the diaphragm by first spring 45, the valve member 51 would move toward the central body portion *3b* until valve stem end 57 engages the valve seat 54 to obstruct the flow of ink into the bypass passageway 11 as illustrated in FIG. 4. In this mode of operation, all of the ink would flow between the diaphragm 41 and central body portion *3b* to the regulator exit passageway 25 and subsequently to the ink jet nozzle 36 at the printhead as represented by the arrows of FIG. 4.

Should the pressure in the system rise to the point where the force exerted on the diaphragm 41 by the pressurized ink and the spring 59 is greater than the force exerted on the diaphragm by spring 45, the diaphragm will be moved away from the central body portion *3b* until equilibrium is established. The valve member 51 will move with the diaphragm away from the mouth of the bypass passageway 11 a corresponding distance under the force of spring 59 as illustrated in FIG. 3. As a result, a portion of the ink flow will be diverted from the regulator exit passageway 25 to the bypass passageway 11 shown schematically by the arrows in FIG. 3. It has been observed that in a steady-state condition the valve stem end 57 separates slightly from the valve seat 54 and remains in a kind of balanced position to allow a low level flow into bypass passageway 11. This operation is believed to enhance the steady pressure and pulsation dampening achieved in the practice of the present invention.

The pressure of the ink entering the print head via the pressure line 37 can be monitored by gauge 31 and screw 51 can be tightened or loosened to adjust the force exerted by pressure plate 53 on diaphragm 41 to control the corresponding pressure of ink to the printhead. Once an equilibrium state is established in the system, the invention will automatically maintain the desired pressure.

In addition to regulating the ink pressure, the design of the present invention also dampens both high and low frequency pulsations in the ink caused by the pump thereby to eliminate the need for a separate dampening mechanism. Specifically, the movement of the central portion 41*a* of the diaphragm and the compression of spring 45 will dampen low frequency pulsations in the ink while the annular edge portion 41*b* will dampen high frequency pulsations in the ink.

Finally, the construction of the body 3, provided with all of the interconnecting passageways and the integration of a regulator valve and dampener in one mechanism, results in a more compact ink delivery system. Moreover, the number of fittings, and the corresponding number of potential leak points, are minimized. Thus, the manufacturing assembly and maintenance costs of the device are reduced.

Although the invention has been described in its preferred form with a certain degree of particularity, it is to be understood that numerous changes in the details and construction of the combination and arrangement of parts will be apparent without departing from the spirit and scope of the invention.

What is claimed is:

1. A valve and pump assembly for an ink jet printer of the type having an ink reservoir for supplying ink to one or more printer heads comprising:

(a) a body having an inlet connected to said reservoir, a fluid passageway through said body, and an outlet connected to said printer heads;

(b) means for pressurizing the ink in the passageway to draw ink from said reservoir and supply it to said printer heads; and (c) means within said body for regulating the pressure of the ink and for dampening pulsations in the ink caused by said pressurizing means including a flexible member in contact with the ink and displaceable as a function of ink pressure and a rigid plate contacting said flexible member over a first portion of its surface, a second portion of said flexible member being out of contact with said plate, whereby said first portion dampens low frequency pulsations and said second portion dampens high frequency pulsations in the ink.

2. A valve and pump assembly for an ink jet printer of the type having an ink reservoir for supplying ink to one or more printer heads comprising:

(a) a body having an inlet connected to said reservoir, a fluid passageway through said body, and an outlet connected to said printer heads;

(b) means for pressurizing the ink in the passageway to draw ink from said reservoir and supply it to said printer heads; and (c) means within said body for regulating the pressure of the ink and for dampening pulsations in the ink caused by said pressurizing means.

3. A valve and pump assembly according to claim 2, wherein said regulating and dampening means includes:

a flexible member disposed within a chamber in the fluid passageway displaceable as a function of the ink pressure in the chamber, and a valve means including a valve member adapted to move with the flexible member for diverting from the outlet a variable portion of the ink flow thereby to regulate the pressure of the ink at said outlet.

4. A valve and pump assembly according to claim 2, wherein said regulating and dampening means includes:

a flexible member in contact with the ink and displaceable as a function of ink pressure, and a valve means including a valve member adapted to move with the flexible member for diverting from the outlet a variable portion of the ink flow thereby to regulate the pressure of the ink at the outlet.

5. A valve and pump assembly according to claim 4, further including a rigid plate contacting said flexible member over a first portion of its surface, a second portion of the flexible member being out of contact with said plate, whereby said first portion dampens low frequency pulsations and said second portion dampens high frequency pulsations in the ink.

6. A valve and pump assembly according to claim 4, wherein said valve means further includes a bypass means cooperating with said valve member for communicating the diverted portion of ink to the pressurizing means.

7. A valve and pump assembly according to claim 4, further including a means for indicating the pressure of the ink at said outlet.

8. A valve and pump assembly according to claim 4, further including a first biasing means for maintaining said valve member into contact with said flexible member, and a second biasing means of variable force providing pressure on the flexible member in opposition to the first biasing means and the ink pressure against the flexible member, whereby diverting of ink does not occur until the combined forces of the ink pressure and the first biasing means exceeds the force of the second biasing means.

9. A valve and pump assembly according to claim 8, further including a rigid plate contacting said flexible member over a first portion of its surface, a second portion of the flexible member being out of contact with said plate, whereby said first portion and said second biasing means dampens low frequency pulsations and said second portion dampens high frequency pulsations in the ink.

10. A valve and pump assembly according to claim 9, further including means for varying the force of the second biasing means whereby the displacement of the flexible member and the corresponding movement of the valve member will vary to thereby divert greater or lesser portions of the ink flow.

* * * * *